US006065192A

United States Patent [19]

Wang

[11] Patent Number: 6,065,192

[45] Date of Patent: May 23, 2000

[54] ZIP-FASTENER

[76] Inventor: Wallace Wang, 1F., No. 30, Lane 252, San Jiunn Street, Shu Lin Chen, Taipei County, Taiwan

[21] Appl. No.: 09/176,216

[22] Filed: Oct. 21, 1998

[51] Int. Cl.[7] ..... A44B 19/14

[52] U.S. Cl. ..... 24/401; 24/414; 24/396

[58] Field of Search ..... 24/414, 396, 413, 24/401, 397

[56] References Cited

U.S. PATENT DOCUMENTS 4,037,295 7/1977 Rojahn et al. .

4,418,449 12/1983 Heimberger et al. .

*Primary Examiner*—James R. Brittain

*Attorney, Agent, or Firm*—Varndell & Varndell, PLLC

[57] ABSTRACT

A zip-fastener in which the hollow lower face of each of the interlocking teeth, which are directly molded on the zipper tapes, has two recessed retaining portions at two opposite vertical lateral sides, top and bottom transverse thread grooves disposed at top and bottom sides and respectively connected between the recessed retaining portions, and stitches are sewn on zipper tapes around the recessed retaining portions and transverse thread grooves of each tooth to fixedly secure the teeth to the zipper tapes.

2 Claims, 8 Drawing Sheets

ZIP-FASTENER

BACKGROUND AND SUMMARY OF THE INVENTION

The present invention relates to a zip-fastener, and more specifically to the fixation of interlocking Plastic teeth on zipper tapes.

A regular zip-fastener is generally comprised of two zipper tapes, two rows of interlocking metal or plastic teeth fastened to the zipper tapes, and a sliding device pulled to close/separate the two rows of interlocking plastic teeth. In a zip-fastener with interlocking plastic teeth, the teeth which are directly molded on the zipper tapes tend to be pulled away from the respective zipper tapes when the sliding device is pulled to close/separate the teeth (see FIGS. 1 and 2). There is known another structure of zip-fastener in which the interlocking plastic teeth are separately molded from nylon and then stitched to the zipper tapes (see FIG. 3). During fabrication, interlocking plastic teeth are disposed in an extended out condition, then arranged in a row on a zipper tape, then stitches are sewn on the zipper tape to fix the teeth to the zipper tape, and then the folded up zipper tape is fix in shape by stitches. Because the interlocking plastic teeth are separately made and then fastened to the respective zipper tapes by a special sewing machine, the fabrication procedure of this structure of zip-fastener is complicated. When the extended out teeth are folded up with the respective zipper tape, the two symmetrical halves of each tooth must be accurately aligned. If the two symmetrical halves of one tooth are not accurately aligned, the finished zipper fastener becomes useless. Furthermore, when the sliding device is suddenly pulled to close/separate the interlocking plastic teeth, the teeth tend to be forced out of position.

The present invention has been accomplished to provide a zip-fastener which eliminates the aforesaid drawbacks. According to one aspect of the present invention, the hollow lower face of each of the interlocking plastic teeth, which are directly molded on the zipper tapes, has two recessed retaining portions at two opposite vertical lateral sides, and top and bottom transverse thread grooves disposed at top and bottom sides and respectively connected between the recessed retaining portions, and stitches are sewn on zipper tapes around the recessed retaining portions and transverse thread grooves of each tooth to fixedly secure the teeth to the zipper tapes. According to another aspect of the present invention, the color of the threads for the stitches can be determined subject to the color of the zipper tapes used, so as to make a prominent contrast.

DETAILED DESCRIPTION OF THE PREFERRED EMBODIMENT

Figure 1:
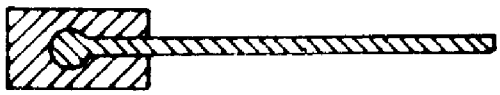
Fig. 1 PRIOR ART
FIG. 1 is a cross sectional view of a part of a zip-fastener according to the prior art, showing the tooth integral with the zipper tape.
Figure 2:
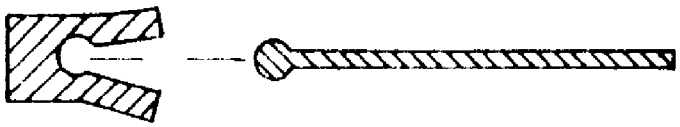
Fig. 2 PRIOR ART
FIG. 2 is a sectional view showing the tooth disconnected from the zipper tape according to the prior art.
Figure 3:
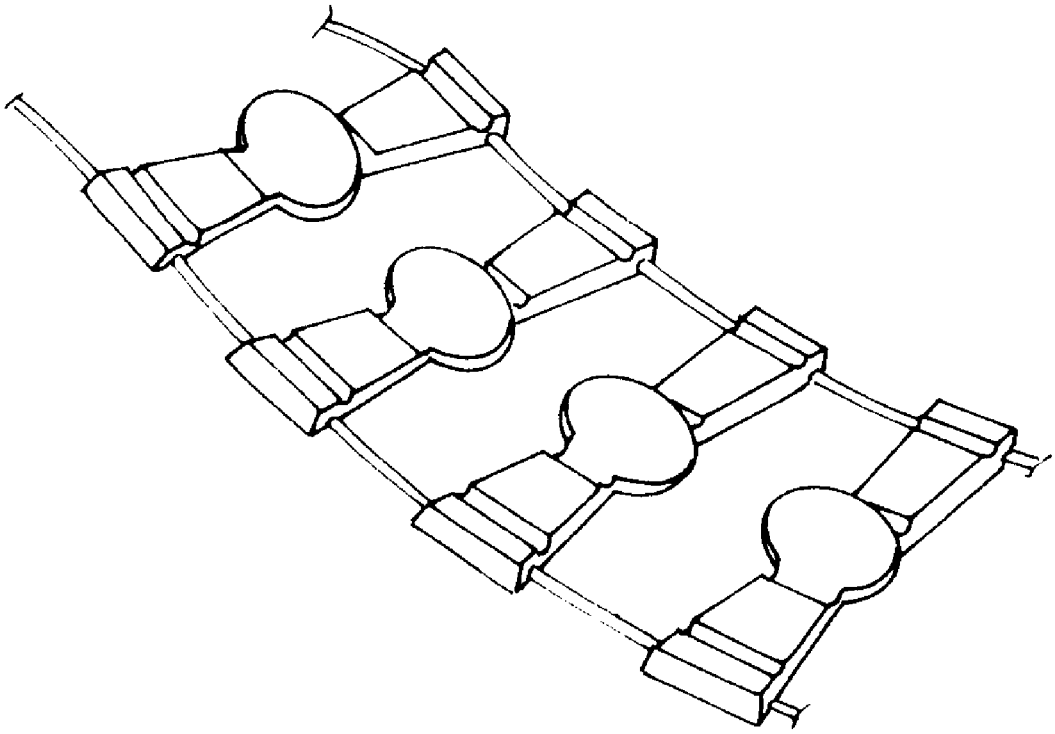
Fig. 3 PRIOR ART
FIG. 3 is an extended out view of a zipper tape with interlocking teeth according to the prior art.
Figure 4:
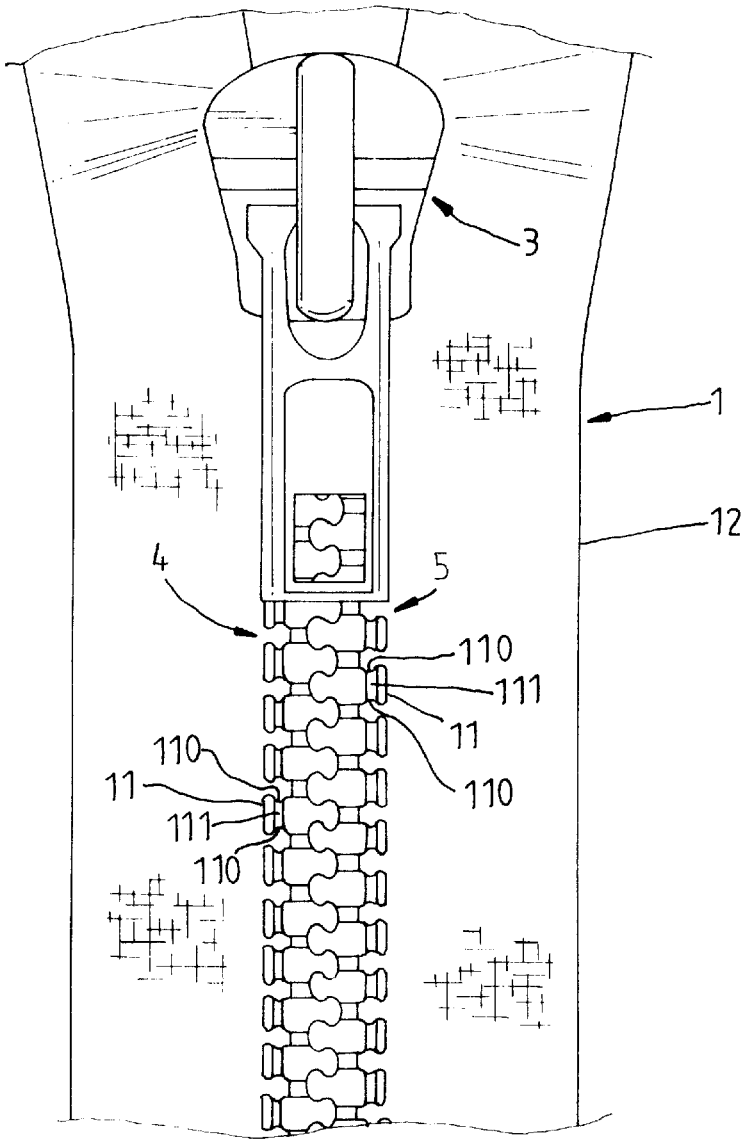
FIG. 4 is a plain view of a zip-fastener according to a first embodiment of the present invention (before the sewing of the stitches).
Figure 5:
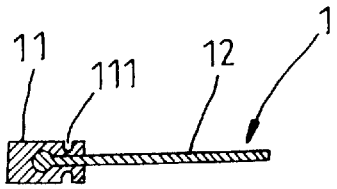
FIG. 5 is a sectional view of a part of FIG. 4.
Figure 6:
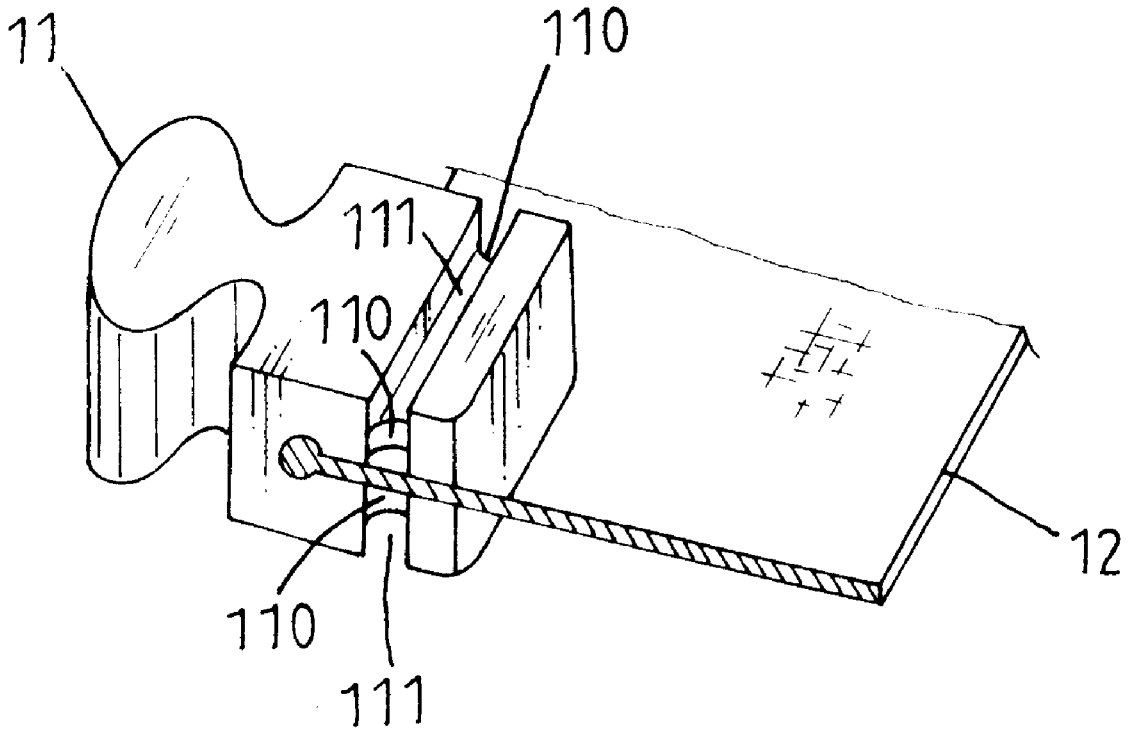
FIG. 6 is a perspective view in an enlarged scale of a part of FIG. 4.

Referring to FIGS. from 4 through 8, a zip-fastener 1 is shown comprised of two zipper tapes 12, two rows 4, 5 of interlocking plastic teeth 11 directly molded on the zipper tapes 12, and a sliding device 3 pulled to close or separate the two rows 4, 5 of interlocking plastic teeth 11. The teeth each have a hollow lower face integral with one zipper tape 12, and a protruding upper face for interlocking.

Figure 7:
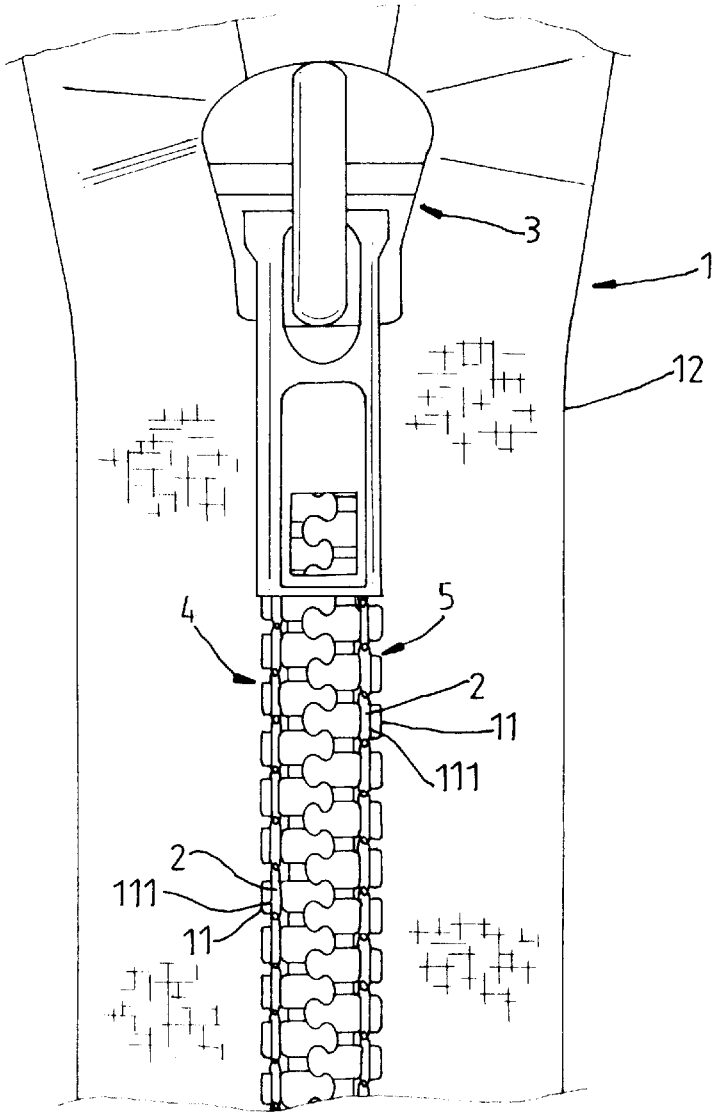
FIG. 7 is similar to FIG. 4 but showing the stitches sewn on the zipper tapes.
Figure 8:
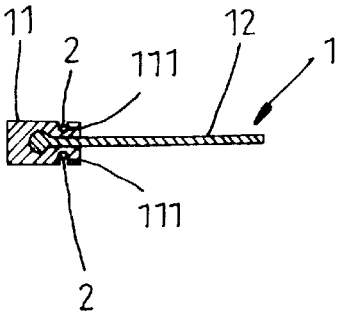
FIG. 8 is a sectional view of a part of FIG. 6.
Figure 9:
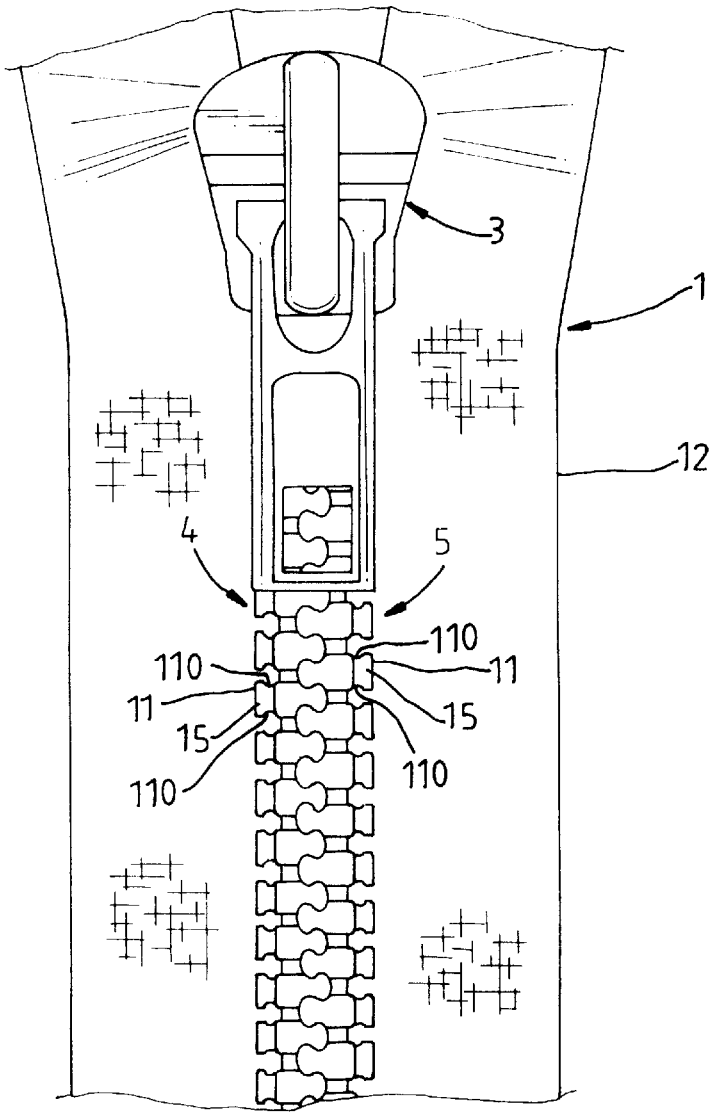
FIG. 9 is a plain view of a zip-fastener according to a second embodiment of the present invnetion (before the sewing of the stitches).
Figure 10:
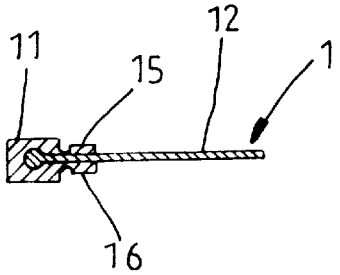
FIG. 10 is a sectional view of a part of FIG. 9.
Figure 11:
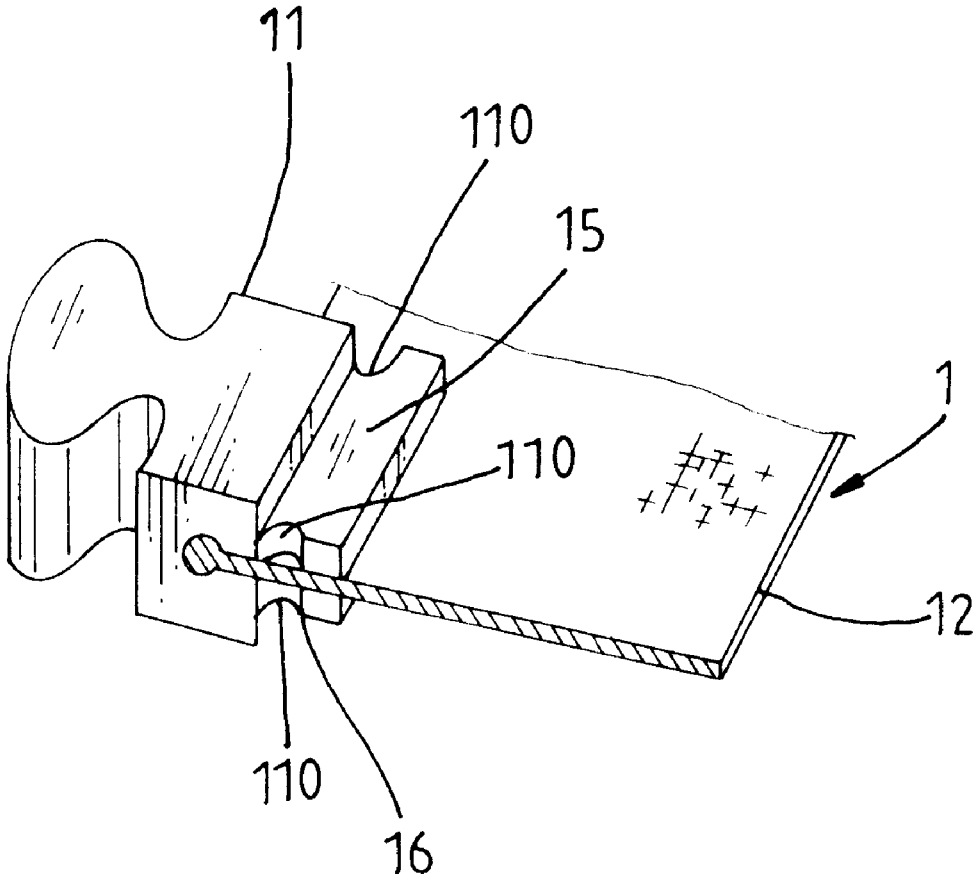
FIG. 11 is a perspective view in an enlarged scale of a part of FIG. 9.
Figure 12:
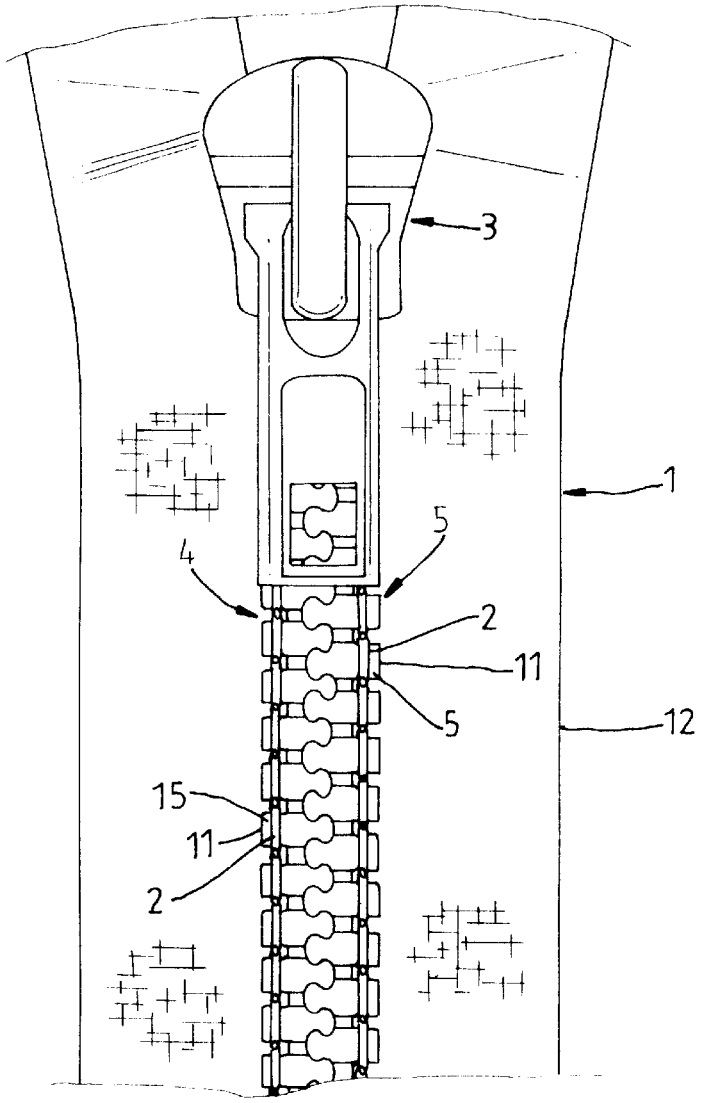
FIG. 12 is similar to FIG. 9 but showing the stitches sewn on the zipper tapes.
Figure 13:
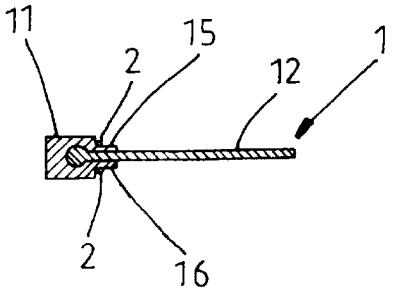
FIG. 13 is a sectional view of a part of FIG. 12.

Each tooth 11 comprises two recessed retaining portions 110 at two opposite vertical lateral sides of its hollow lower face, top and bottom transverse thread grooves 111 disposed at top and bottom sides of its hollow lower face and respectively connected between the recessed retaining portions 110 (see FIGS. from 4 through 6). Stitches 2 are sewn on the zipper tapes 12 around the recessed retaining portions 110 and the transverse thread grooves 111 to fix secure the teeth 11 to the zipper tapes 12 (see FIGS. 7 and 8). The depth of the transverse thread grooves 111 is greater than the diameter of the threads for the stitches 2, therefore the sliding device 3 does not touch the stitches 2 when it is pulled to close/separate the teeth 11 (see FIGS. 7 and 8).

Referring to FIGS. from 9 through 13, the hollow lower face of each tooth 11 has a recessed top plane 15 and a recessed bottom plane 16 at its rear end, and two recessed retaining portions 110 at two opposite vertical lateral sides of the rear end between the recessed top plane 15 and the recessed bottom plane 16. Stitches 2 are sewn on the zipper tapes 12 around the recessed retaining portions 110 and recessed top and bottom planes 15, 16 of each tooth 11 of fixedly secure the teeth 11 to the zipper tapes 12. Because the stitches 2 are fastened to the thinner rear end of the hollow lower face of each tooth 11, pulling the sliding device 3 to close/separate the teeth 11 does not cause the slide of the sliding device 3 to touch the stitches 2, therefore the sliding device 3 can smoothly be moved to close/separate the teeth 11.

Because the teeth 11 are respectively integral with the zipper tapes 12 and stitches 2 are sewn on the zipper tapes 12 to fixedly secure the hollow lower faces of the teeth 11 to the zipper tapes 12, pulling the sliding device 3 does not cause the teeth 11 to displace. The color of the threads for the stitches 2 can be determined subject to the color of the zipper tapes 12 used, so as to make a prominent contrast. Furthermore, the depth of the transverse thread grooves 111 of the teeth 11 or the elevation difference between the top or bottom side wall of the hollow lower face of each tooth and the corresponding recessed top or bottom plane 15, 16 is determined subject to the diameter of the threads used for the stitches 2 so that the stitches 2 can be well protected when the sliding device 3 is moved to close/separate the teeth. The aforesaid design can be matched with a gapping machine to determine the size and specifications of the zip-fastener subject to individual customers' requirements.

What is claimed is:

1. A zip-fastener comprising two zipper tapes, two rows of interlocking plastic teeth directly molded on said zipper tapes, and a sliding device pulled to close/separate said two rows of interlocking plastic teeth, said teeth each having a hollow lower face integral with one zipper tape, and a protruding upper face for interlocking, wherein the hollow lower face of each of said teeth comprises two recessed retaining portions at two opposite vertical lateral sides thereof, top and bottom transverse thread grooves disposed at top and bottom sides thereof and respectively connected between said recessed retaining portions, and stitches are sewn on said zipper tapes around the recessed retaining portions and transverse thread grooves of each of said teeth to fixedly secure said teeth to said zipper tapes, the depth of said transverse thread grooves being greater than the diameter of said stitches.

2. A zip-fastener comprising two zipper tapes, two rows of interlocking plastic teeth directly molded on said zipper tapes, and a sliding device pulled to close/separate said two rows of interlocking plastic teeth, said teeth each having a hollow lower face integral with one zipper tape, and a protruding upper face for interlocking, wherein the hollow lower face of each of said teeth has a thin rear end, a recessed top plane and a recessed bottom plane at said thin rear end, and two recessed retaining portions at two opposite vertical lateral sides of said thin rear end between said recessed top plane and said recessed bottom plane, and stitches are sewn on said zipper tapes around the recessed retaining portions and recessed top and bottom planes of each of said teeth to fixedly secure said teeth to said zipper tapes.

* * * * *